US005758389A

United States Patent [19]

Wolda

[11] Patent Number: 5,758,389

[45] Date of Patent: Jun. 2, 1998

[54] TORSION ROD ASSISTED HINGES

[75] Inventor: Tiete O. Wolda, Ontario, Canada

[73] Assignee: M & C Corporation, Warren, Mich.

[21] Appl. No.: 239,358

[22] Filed: May 6, 1994

[51] Int. Cl.[6] ..... E05F 1/08

[52] U.S. Cl. ..... 16/308; 16/302

[58] Field of Search ..... 16/75, 308, 302; 180/69.21

[56] References Cited

U.S. PATENT DOCUMENTS

| | | | |
|---|---|---|---|
| 2,091,673 | 8/1937 | DeOrlow | 16/370 |
| 2,188,891 | 1/1940 | Haltenberger | 16/308 |
| 2,783,495 | 3/1957 | Vigmostad | 16/308 |
| 3,153,257 | 10/1964 | Daenzer | 16/308 |
| 3,153,258 | 10/1964 | Badura | 16/308 |
| 4,378,658 | 4/1983 | DeLorean | 16/308 |
| 4,949,426 | 8/1990 | Komaki | 16/308 |

FOREIGN PATENT DOCUMENTS

| | | | |
|---|---|---|---|
| 2281480 | 3/1976 | France | 16/308 |
| 633937 | 8/1936 | Germany | 16/75 |
| 2069037 | 8/1981 | United Kingdom | 16/308 |

*Primary Examiner*—Maurina T. Rachuba
*Assistant Examiner*—Donald M. Gurley
*Attorney, Agent, or Firm*—Brooks & Kushman P.C.

[57] ABSTRACT

Two laterally spaced hinges (18, 20) each comprising a pair of pivotally connected brackets (22, 24) (74, 74') one bracket being connected to the hood (10) (10') or deck lid and the other to the edge of the vehicle opening. A pair of links (42, 44) (82, 84) pivotally connected together at one end extend between the brackets of each hinge. Each pair of links is pivotally connected at opposite ends to the associated brackets and in a first embodiment arranged such that the links of one pair (42) fold and unfold in opposite directions from the links of the other pair (44) when the hinges are swung during opening or closing of the hood or deck lid. In a second embodiment, the two pairs of links (82, 84) fold in the same direction. A torsion rod (36) (104) extends between the hinges and is connected at opposite ends to the links of each pair, such that upon closing the deck lid or hood, the links twist the torsion rod at its ends in opposite directions to tension it.

11 Claims, 4 Drawing Sheets

TORSION ROD ASSISTED HINGES

CROSS-REFERENCE TO RELATED APPLICATION

This application is a continuation-in-part of my earlier Patent Cooperation Treaty application Ser. No. PCT/US93/07508, filed Aug. 9, 1993, by M&C Corporation, to which the instant application is also assigned.

TECHNICAL FIELD

This invention relates to torsion rod assisted hinges for hood and deck lids for automotive vehicles though it may have much broader applications.

BACKGROUND OF THE INVENTION

The following patents show torsion rod assisted hinges for deck lids or hoods for automotive vehicles: U.S. Patent Nos. 2,091,673; 2,188,891; 2,783,495; 4,378,658; 4,580,315; and 4,949,426.

In each of these but U.S. Pat. No. 2,188,891, two torsion rods are required to assist in opening and maintaining the hood or deck lid in the open position. One end of each rod is fastened to the vehicle body and the other end is fastened to the hood or deck lid, generally through a link member, and is in a twisted tension which serves to hold the lid or hood open, but will yield to manual closing force against the lid or hood to allow the same to be swung closed. In U.S. Pat. No. 2,188,891, a single torsion rod is held midway between its ends locked against rotation to the vehicle body while its ends are connected to the hinge trunions of the lid or hood. In effect, two torsion rods are present, one on each side of the central connection of the rod to the vehicle body, such that the arrangement is the same as that of the other prior art except the torsion rods are shorter. The portions of the torsion rod on opposite sides of its central connection to the vehicle body are twisted in the same direction during opening and closing of the hood.

SUMMARY OF THE INVENTION

I have discovered a simple and effective way to utilize but one torsion rod which, unlike the prior art, is not locked against rotation to the vehicle body but is directly connected at opposite ends to the hood or deck lid hinge assemblies. Thus, there is an economy in eliminating one torsion rod of the prior art, and the steps needed to assemble it to the vehicle is simplified, thereby reducing installation cost.

Two embodiments of the invention are disclosed herein. In both of them, an automotive hood or deck lid is pivotally mounted to the trunk or engine compartment by two laterally spaced hinges, each comprising a pair of pivotally connected brackets. One bracket of each pair is connected to the hood or deck lid and the other to the edge of the vehicle opening. A pair of links pivotally connected together at one end extend between the brackets of each hinge. Each pair of links is pivotally connected at opposite ends to its associated pair of brackets with one link connected to one bracket and the other link connected to the other bracket. A torsion rod extends between the pairs of brackets and is connected at each end to one link of each pair, with the arrangement being such that during closing movement of the deck lid or hood, the links pivot to twist opposite ends of the torsion rod in opposite directions to increase torsion in the rod, and upon opening the deck lid or hood, the rod ends twist in the opposite direction reducing torsion in the rod and assisting the opening.

In the first embodiment, the pairs of links are arranged such that the links of one pair fold and unfold in opposite directions from the links of the other pair when the hinges are swung during opening or closing of the hood or deck lid, and the torsion rod is connected at opposite ends to corresponding links of each pair. For example, opposite ends of the rod may be connected to the links which are connected to those brackets fastened to the vehicle body. Thus, upon closing the deck lid or hood, the links fold in opposite directions twisting the torsion rod at its ends in opposite directions to tension it, and when the trunk or deck lid is opened, the links unfold in opposite directions assisting the opening motions and relaxing the rod.

In the second embodiment, the links fold in the same direction but, unlike the first embodiment, opposite ends of the torsion rod are connected to opposite links of the pairs. For example, one end of the rod is connected to that link which is fastened to the bracket secured to the vehicle body, while the other end of the rod is connected to that link fastened to the bracket secured to the hood or deck lid. In effect then, the torsion rod is secured at one end to a link pivoted to the vehicle body and at the other end is secured to a link pivoted to the hood or deck lid. The swinging movement of opposite links of the two pairs of links is in opposite directions such that upon closing of the hood or deck lid, opposite ends of the torsion rod are twisted in opposite directions to increase torsion in the rod, while when the hood or deck lid is opened, opposite ends of the rod untwist in opposite directions thereby assisting in raising the hood or deck lid and hold the same in the open position.

As herein disclosed, opposite ends of the torsion rod may be angularly bent to provide a lever arm and the rod journalled in a hinge bracket adjacent the bent end which may be connected to one of the links of each pair of links. In this case, the rod itself forms the pivotal connection for the link to which the bent end is attached. Alternatively, the bent end of the torsion rod may itself be fashioned as one of the links and pivotally connected to the other link of the pair. In such case, the bent end of the rod may be configured as a U-shape with the distal side of the U serving as the pivot pin or axis for the connection between the pair of links.

DESCRIPTION OF PREFERRED EMBODIMENTS

Figures 1, 2, 3, 4:
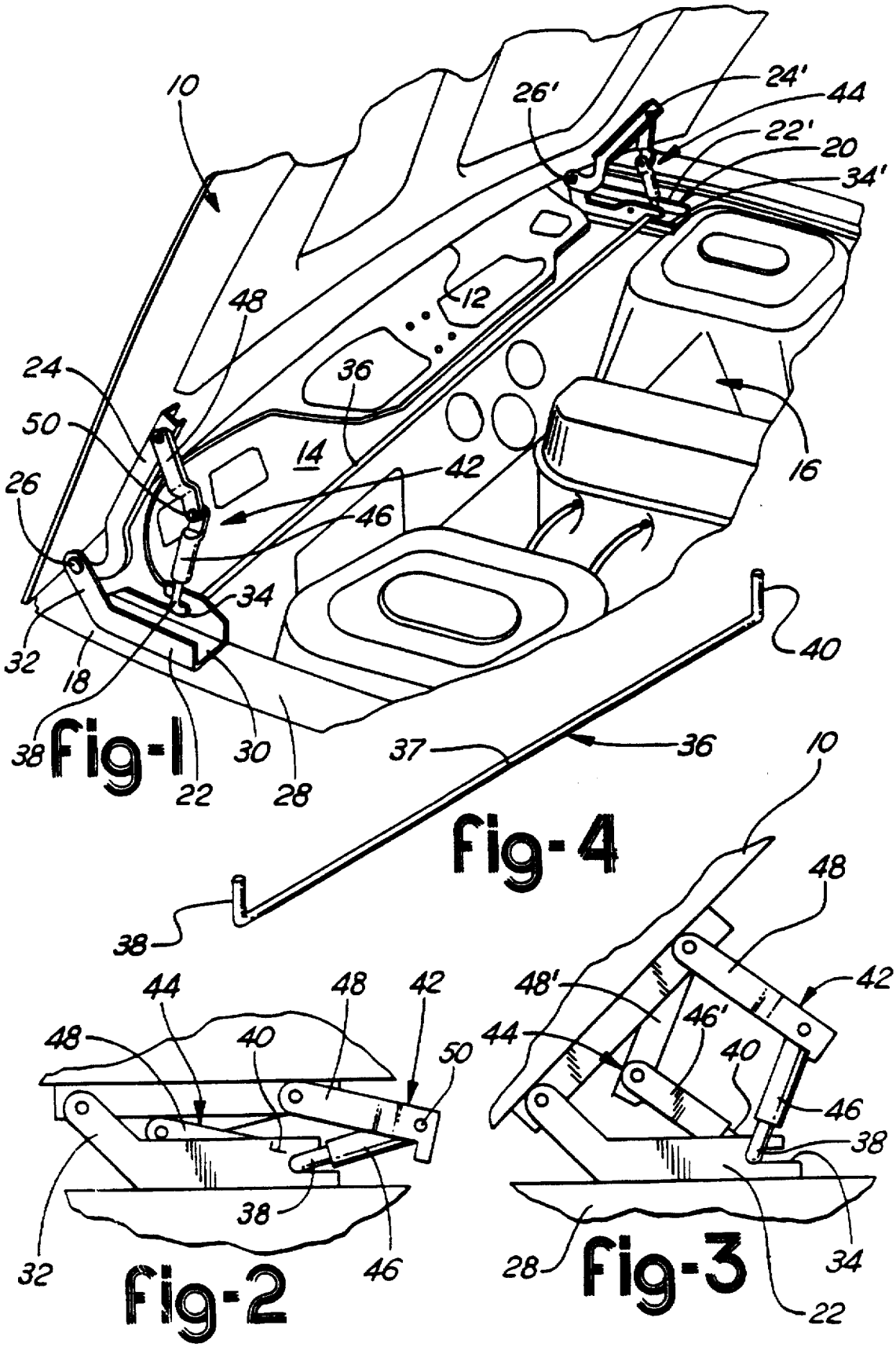
FIG. 1 is a perspective view of an engine compartment and raised hood showing a first embodiment of my improved torsion rod assisted hinges.
FIGS. 2 and 3 show the hinge brackets and oppositely folding links in the closed and open positions, respectively, of the first embodiment.
FIG. 4 is a perspective view of one form of a torsion rod for use in the first embodiment of my invention.

In FIG. 1, I have shown a representative hood 10 for an automobile hinged along one edge 12 to an edge 14 of an engine compartment 16 to be closed by the hood 10. While a hood and engine compartment are shown, it will be understood that my invention is equally applicable to a deck lid and trunk compartment. The hood is preferably mounted on the vehicle by two laterally spaced apart hinges 18 and 20, each consisting of a pair of brackets 22 and 24 pivotally connected together as at 26. Primed reference numerals are used to designate corresponding parts in this disclosure.

Brackets 24 and 24' are connected to the hood by suitable fasteners, not shown, while brackets 22 and 22' are similarly connected to the vehicle 28. These brackets may be of a variety of shapes, but in the preferred embodiment are sheet metal stamping. Each of brackets 22 and 22' has a trough-shaped portion 30, one wall of which is provided with an extension 32 which provides one side of the hinge, while the other side wall of the bracket is cut out to provide a journal slot 34 and 34' for receiving and supporting for rotation the end of the torsion rod 36 adjacent an angularly bent end 38 and 40.

The torsion rod 36 is best shown in FIG. 4. In a preferred form, it is a spring steel rod having a rectilinear portion 37 angularly bent at opposite ends 38 and 40 which, in a relaxed condition of the rod, may be parallel to each other and substantially perpendicular to the remainder of the rod. However, if desired, the ends may be bent to lie on opposite sides of an imaginary plane coextensive with the remainder of the rod if it is desired to increase or decrease the tensions in the rod when it is installed in the vehicle. The rod extends between the bracket assemblies and is journalled in the journal slots 34 and 34' as shown in FIG. 1 just inboard of the bent ends 38 and 40.

Figure 5:
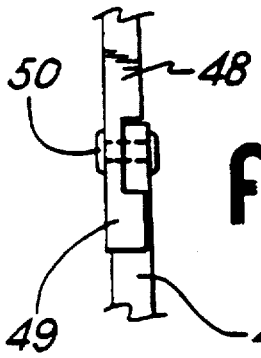
FIG. 5 is a fragmentary view looking in the direction of arrow 5 in FIG. 3.

Two pairs of pivotally connected, oppositely folding links 42 and 44 are disposed in laterally spaced apart relation between the hinged edge 12 of the hood and the side 14 of the engine compartment. Each pair of links is connected to and extends between its associated hinge brackets. Each pair of links consists of a pair of link members 46 and 48 pivotally connected together at one end as at 50. The free end of the link 48 is pivotally connected to the bracket 24, while the free end of link 46 is pivotally connected through the bent end of the torsion rod to the bracket 22. Link 46 is provided with a longitudinally extending bore sized to receive in press fit or other secure engagement the bent end of the torsion rod. It will be noted that the bent ends 38 and 40 in effect become a part of links 46 and 46'. Stops 49 and 49' are formed on the ends of links 48 and 48' as shown in FIGS. 3 and 5, and overlie links 46 and 46' to limit the unfolding movement of the pair of links.

In FIGS. 2 and 3, I have shown the oppositely folding action of the pairs of links 42 and 44. In FIG. 2, the link pairs are in their folded position which would be the case where the hood is closed, while in FIG. 3, the link pairs have unfolded and have assumed their distended positions when the hood is opened. Moving from FIG. 2 to FIG. 3, the torsion rod is unwinding and assisting the hood to be raised, while in FIG. 3, the distended position of the link pairs serves to keep the hood open. As the hood is closed, the link pairs move from the FIG. 3 position to the FIG. 2 position and in doing so twist the torsion rod 36 between its ends to store the kinetic energy which is recovered to assist the opening of the hood. Thus, a single torsion rod may serve the prior art function of two rods and by being connected at its ends to the oppositely folding links, the torsion rod need not be locked to the vehicle body as in the prior art.

Figure 7:
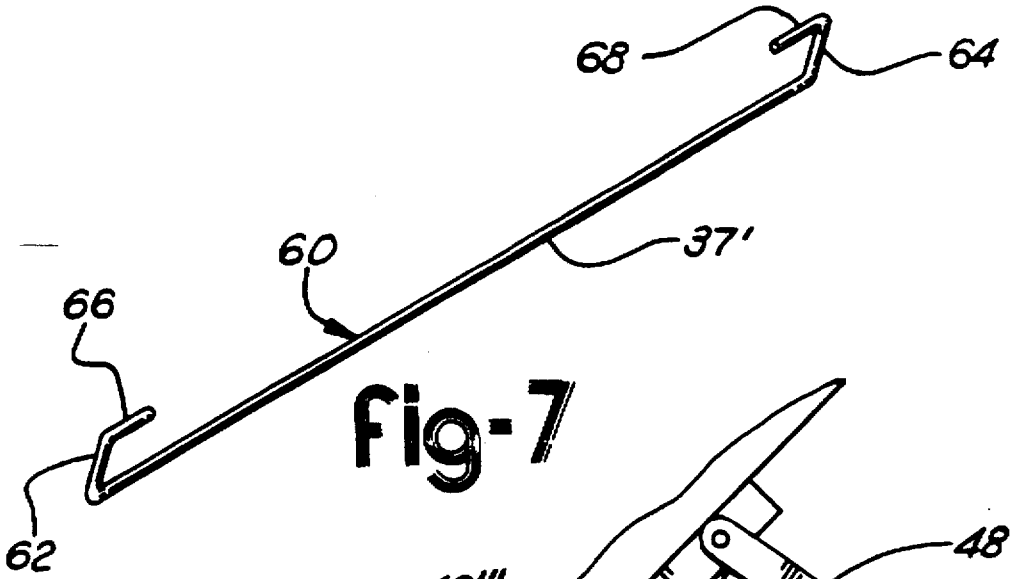
FIG. 7 is a perspective view of a torsion rod for use in the modification of FIG. 6.
Figure 6:
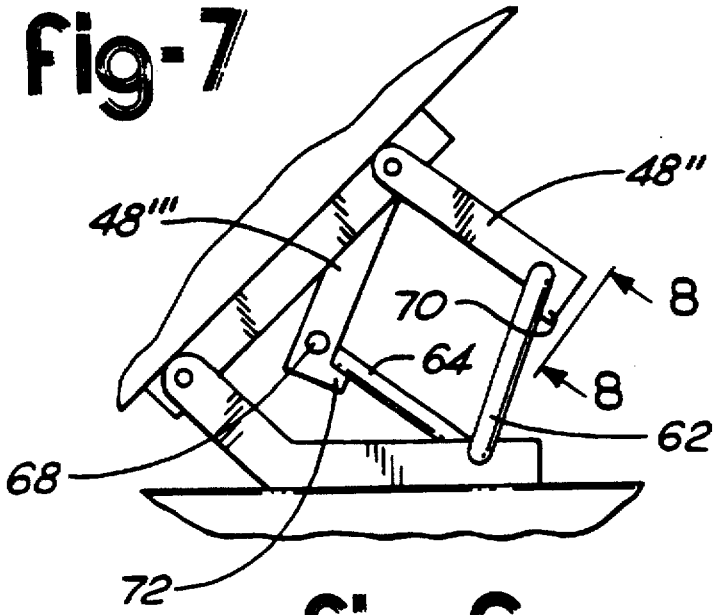
FIG. 6 shows an alternative torsion rod and link arrangement for use in my first embodiment of the invention.
Figure 8:
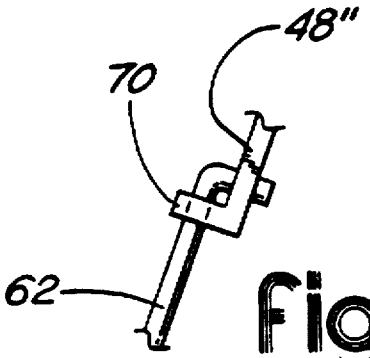
FIG. 8 is a fragmentary view looking in the direction of arrow 8 of FIG. 6.

In FIGS. 6–8, I have shown a modification in which the torsion rod 60 has angularly bent ends which serve as the second link member of each pair of links. For this purpose, opposite ends of the torsion rod are bent into U-shaped configurations having a bight or lever portion 62 and 64 and a distal end 66 and 68 which lie substantially parallel to the rectilinear portion 37'. The distal ends act as pintles and are received through complementary holes in upper links 48" and 48'" which correspond to upper links 48 and 48, respectively, in FIGS. 1–3. The end of links 48" and 48'" connected to the end of the torsion rod is provided with an extending portion shaped as a stop 70 and 72 as best shown in FIGS. 6 and 8 to limit unfolding of the links.

In this disclosure, I have shown the torsion rod being journalled in bracket members 22 and 22', but it will be understood that the torsion rod could be journalled in brackets 24 and 24'.

It will also be noted that when the hood or deck lid is closed, opposite ends of the torsion rod are twisted in opposite directions such that the rod is twisted in opposite directions throughout its length.

This invention may be found useful in connection with any hinged closure member that requires counterbalancing such as, but not limited to, boat or aircraft hatches, lids for drawing, storage cabinets, and the like.

In the second embodiment of the invention shown in FIGS. 9–13, I have used corresponding but primed reference numerals to indicate parts corresponding to those of FIGS. 1–8, and have also used primed numerals to indicate corresponding parts at opposite sides of the hood. In this second embodiment, two pairs of identical hinges 74 and 74' are disposed in laterally spaced relation, one at each side of the hood 10'. A description of one of the hinges will suffice for both. Each has a pair of pivotally connected brackets 76 and 78; the former is secured in any suitable fashion to the hood 10' and the latter to the vehicle 28'. The brackets are pivotally connected at 80, and serve to support the hood for swingable movement between open and closed positions as in FIGS. 10 and 11. While particular bracket designs have been shown, the brackets may assume a variety of shapes.

Figure 13:
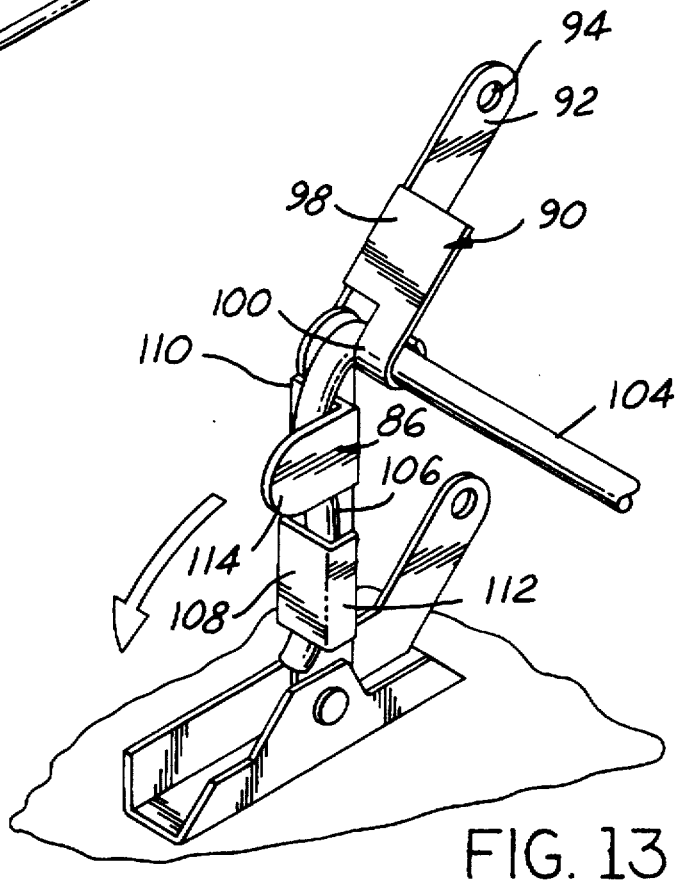
FIG. 13 is a perspective view of one of the pairs of links of the second embodiment of my invention.

Two pairs of pivotally connected links 82 and 84 are arranged in laterally spaced relation, with one link of each pair arranged for pivotal connection to the vehicle 28' and the other link to the hood 10'. As shown, each pair of links is associated with one of the pairs of hinge brackets. As the link pairs are identical, a description of one will suffice. While the pairs of links are identical, one pair is mounted in inverted relation to the other between the hinge brackets as clearly shown in FIG. 9. Each pair of links has a first link 86 pivotally connected at 88 to a second link 90. Link 90 has a flat strap portion 92, as shown in FIG. 13, pierced at its distal end 94 to receive a pivot 96 for pivotally connecting the link to the hinge bracket 76. The strap portion 92 has an ear 98 extending perpendicularly therefrom and terminating in a torsion rod retaining loop 100 which is wrapped around the torsion rod 104 adjacent the end 106 thereof. The retaining loop 100 holds the axis of the rectilinear portion of the torsion rod substantially aligned with the axis of the pivotal connection 88 between link 90 and its companion link 86.

The companion link 86 is also pierced at its distal end to receive a pivot 87 by which it may be connected to the bracket 74. Link 86 has means for retaining the end 106 of the torsion rod to cause the rod to twist as the link pivots. Such means may take a variety of forms, but in this instance comprises two ear portions 108 and 110 extending laterally from the strap portion 112 of the link. As best shown in FIG. 13, ear 108 has a downwardly turned lip 112 while ear 110 has an upwardly turned lip 114. The end 106 of the torsion rod passes over the ear 110 and under the ear 108 and is trapped by the lips 112 and 114 against inadvertent dislodgement. Thus as the pair of links 86 and 90 pivot during opening and closing of the hood, the ends of the torsion rod twists therewith.

Figure 9:
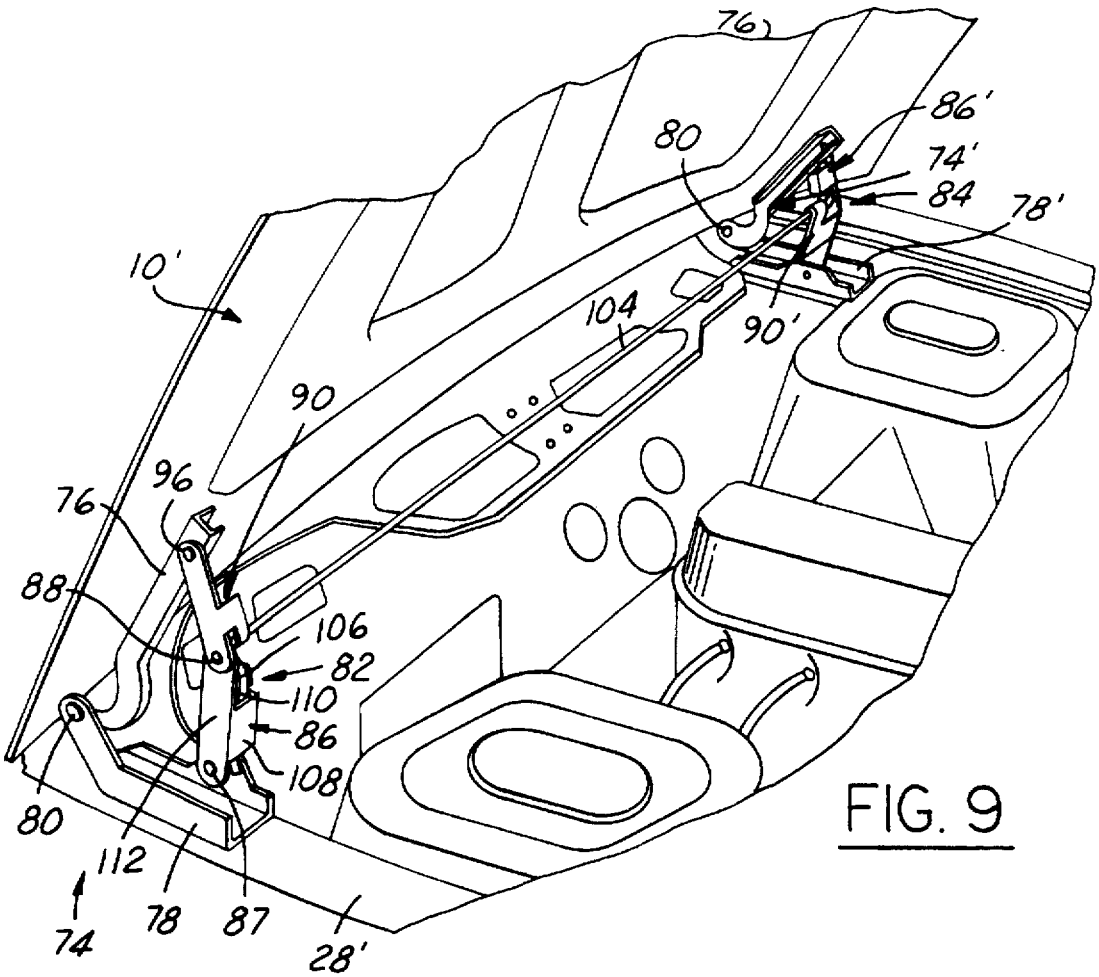
FIG. 9 is a perspective view of an engine compartment and raised hood showing a second embodiment of my improved torsion rod assisted hinges.
Figure 10:
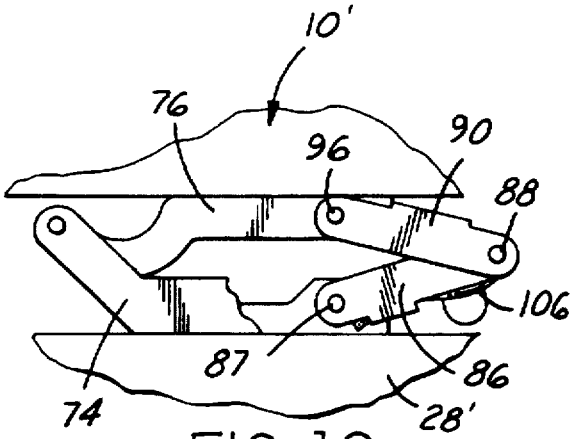
FIGS. 10 and 11 show the hinge brackets and folding links in the closed and open positions, respectively, of the second embodiment of my invention.
Figure 11:
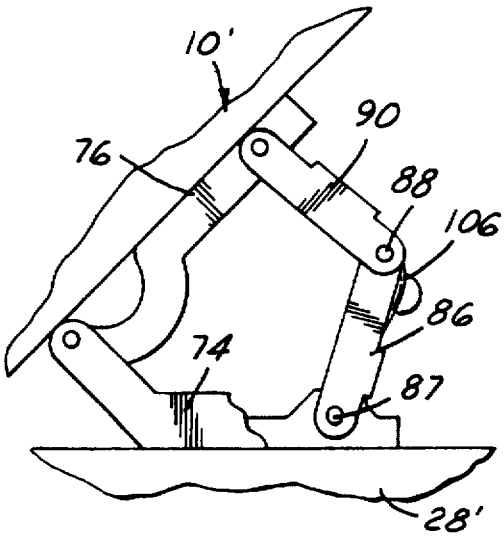
Figure 12:
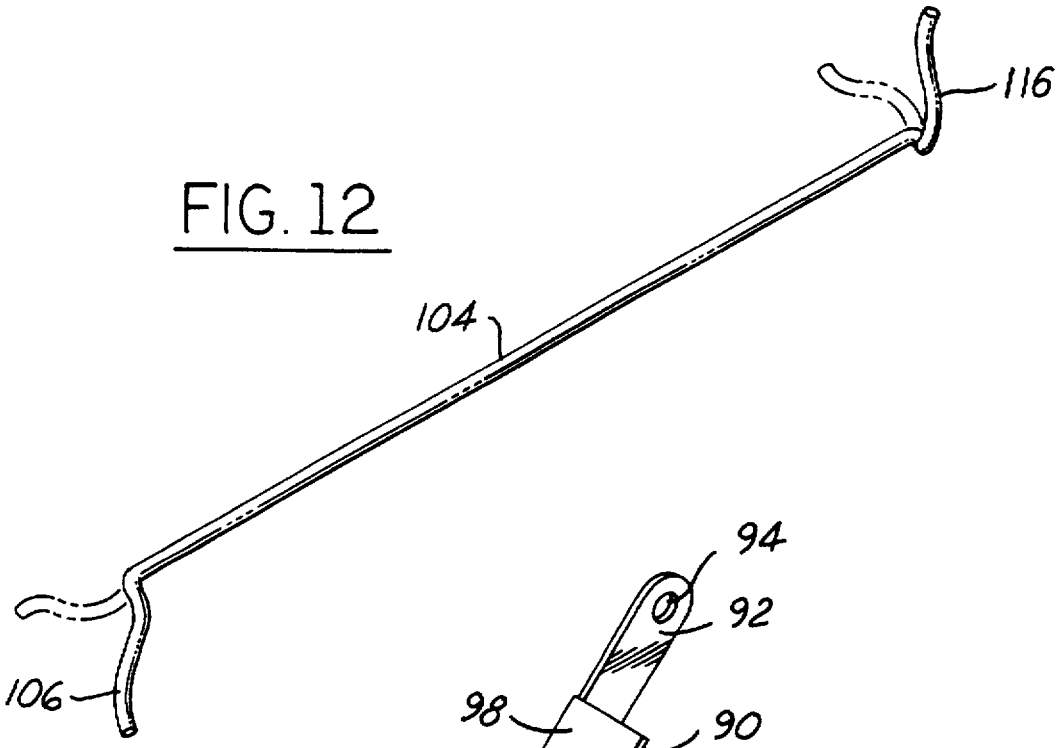
FIG. 12 is a perspective view of a torsion rod for use in my second embodiment of the invention showing in solid outline opposite ends of the torsion rod as when the hood or deck lid is in an open position, and in phantom outline representative positions when the torsion rod has been twisted as in the closed position of the hood or deck lid.

Having described the pairs of links 82 and 84 it need only be pointed out that link pair 84 as shown in FIG. 9 is inverted from the pair 82, i.e., link 86 of pair 82, is operatively connected to the vehicle body through the bracket 74, and its companion link 90 is operatively connected to the hood 10' through the bracket 76, while the reverse is true of the link pair 84. As a result of such design, the ends 106 and 116 of the torsion rod are secured in the same fashion to both pairs of links, but with the link pairs inverted, when the links fold—in this embodiment the links fold in the same direction, not in opposite directions as in the first embodiment—the ends of the torsion rod are twisted in opposite directions as the hood is closed to tension the rod, and untwisted in opposite directions to assist raising the hood when it is opened.

In both embodiments the rod ends are twisted in opposite directions, but the second embodiment accomplishes this with the link pairs folding in the same direction by inverting the links, or, in other words, by connecting one end of the rod to the link operatively connected to the vehicle body and connecting the other end of the rod to the link operatively connected to the hood. Certain advantages result from the second embodiment. The mounting of the torque rod is such that its main body, hereinabove referred to as its rectilinear portion, moves during opening and closing movements parallel to itself, and when the hood is opened the rod is moved out of the way to improve access to the engine compartment. The same would be true when the system is used with the deck lid. Friction is reduced in this design at the bearing points. Both ends of the torque rod move through exactly the same angle simultaneously during open and closing movements.

Manufacturing costs are reduced because all parts at one hinge assembly are identical with the parts at the opposite hinge assembly. Finally, it is easier to install the torque rod in the second embodiment during assembly of the vehicle.

While the forms of the invention herein disclosed constitute presently preferred embodiments, many others are possible. It is not intended herein to mention all of the possible equivalent forms or ramifications of the invention. It is understood that the terms used herein are merely descriptive rather than limiting, and that various changes may be made without departing from the spirit or scope of the invention.

What is claimed is:

1. A torsion rod assembly for yieldingly holding in an open position a closure member pivotally supported on a structure to be closed comprising, in combination:

two pairs of pivotally connected links arranged in laterally spaced apart relation, with one link of each pair arranged for pivotal connection to the closure member and the other link arranged for pivotal connection to a structure to be closed by such member; and a single torsion rod extending between said two pairs of links and having opposite ends angularly bent with each bent end connected to one link of each pair to twist the ends of the rod in opposite directions against the torsion of the rod during closing movement of the closure member and untwisting of the rod during opening movement of the closure member.

2. The invention defined by claim 1 wherein said pairs of links pivotally fold in the same direction and one end of the torsion rod is connected to said one link of one pair and the opposite end of the torsion rod is connected to said other link of the other pair.

3. The invention defined by claim 1 wherein said pairs of links pivotally fold in opposite directions and opposite ends of the torsion rod are connected to corresponding links of the two pairs.

4. The invention defined by claim 1 wherein each bent end of the torsion rod comprises one of the links of each pair.

5. The invention defined by claim 1 wherein the torsion rod has a rectilinear portion between said angularly bent ends and each bent end is bent in a U-shaped configuration having a distal end lying substantially parallel to the rectilinear portion, and such distal end forming a pintle for connection to the other link of each pair of links.

6. A hinge assembly for pivotally supporting a closure member and holding the same in an open position in relation to a structure to be closed comprising, in combination:

two laterally spaced apart hinges for connection between the closure member and the structure to be closed for supporting the closure member for swingable movement between open and closed positions;

each hinge having a pair of pivotally connected brackets, one bracket for connection to the closure member and the other for connection to the structure to be closed;

a single torsion rod extending between said laterally spaced apart hinges;

two pairs of pivotally connected links, with one pair of links located at each hinge, and one link of each pair connected to said one bracket and the other link of each pair connected to said other bracket; and opposite ends of said torsion rod connected to said pairs of links at the hinges for twisting the rod in opposite directions against the torsion of the rod throughout the length thereof during closing movement of the closure member and untwisting of the rod during opening movement of the closure member.

7. The invention defined by claim 6 wherein said two pairs of links pivotally fold in the same direction and one end of the torsion rod is connected to said one link of one pair and opposite end of the torsion rod is connected to said other link of the other pair.

8. The invention defined by claim 6 wherein said pairs of links pivotally fold in opposite directions and opposite ends of the torsion rod are connected to corresponding links of the two pairs.

9. A closure structure for a motor vehicle comprising, in combination:

a vehicle body having an upwardly opening compartment;

a closure member for closing said compartment;

two laterally spaced apart hinges each having two pivotally connected hinge brackets, with one bracket of each hinge connected to the vehicle body and the other bracket connected to the closure member whereby the hinges support the closure member for swingable movement between an open position extending upwardly from the compartment and a closed position overlying the compartment adjacent the vehicle body;

a single torsion rod extending between the hinges;

a pair of pivotally connected links at each hinge with one link connected to said one bracket and the other link connected to said other bracket; and opposite ends of said torsion rod connected to said pairs of links at the hinges for twisting the rod in opposite directions against the torsion of the rod throughout the length thereof during closing movement of the closure member and untwisting of the rod during opening movement of the closure member.

10. The invention defined by claim 9 wherein said pairs of links pivotally fold in the same direction and one end of the torsion rod is connected to said one link of one pair and the opposite end of the torsion rod is connected to said other link of the other pair.

11. The invention defined by claim 9 wherein said pairs of links pivotally fold in opposite directions and opposite ends of the torsion rod are connected to corresponding links of the two pairs.

* * * * *